United States Patent [19]

Graf

[11] 4,130,050

[45] Dec. 19, 1978

[54] PROCESS AND APPARATUS FOR THE PRODUCTION OF CARDBOARD PLATES AND THE LIKE

[75] Inventor: Godi Graf, Effretikon, Switzerland

[73] Assignee: Maschinenfabrik Gietz AG., Switzerland

[21] Appl. No.: 806,059

[22] Filed: Jun. 13, 1977

[30] Foreign Application Priority Data

Aug. 31, 1976 [CH] Switzerland ..... 11104/76

[51] Int. Cl.[2] ..... B31D 5/02; B31F 1/00

[52] U.S. Cl. ..... 93/1 D

[58] Field of Search ..... 93/1 D, 60, 36 B, 51 R

[56] References Cited

U.S. PATENT DOCUMENTS

| | | | |
|---|---|---|---|
| 527,146 | 10/1894 | Eschenbeck | 93/51 R |
| 2,334,213 | 11/1943 | Murch | 93/36 B X |
| 2,489,507 | 11/1949 | Shapiro et al. | 93/60 |

*Primary Examiner*—James F. Coan

*Attorney, Agent, or Firm*—Larson, Taylor and Hinds

[57] ABSTRACT

A machine for producing cardboard plates or the like comprises punching apparatus for punching or cutting off pieces of sheet material and delivering them edgewise under gravity to be received alternately by two containers. One container is open at each end, the second is permanently closed at one end. The first container is fixed to an oscillating unit and the second is pivoted thereto. When swinging in one direction the unit carries the first container to a position for receiving a piece from the punching apparatus and the second container to a vertical guiding element leading to one pair of dies on a twin press. In the reverse movement, the oscillating unit carries the first container to a position for feeding its piece through its opposite end to a second vertical guiding element leading to the second pair of dies in the press. In this movement, a link swings the second container about its axis on the oscillating unit to present the open end of the container to the punching apparatus. Controlled flaps prevent the pieces from falling prematurely from the containers. The pairs of dies are actuated alternately by a curved rotary thrust element.

7 Claims, 1 Drawing Figure

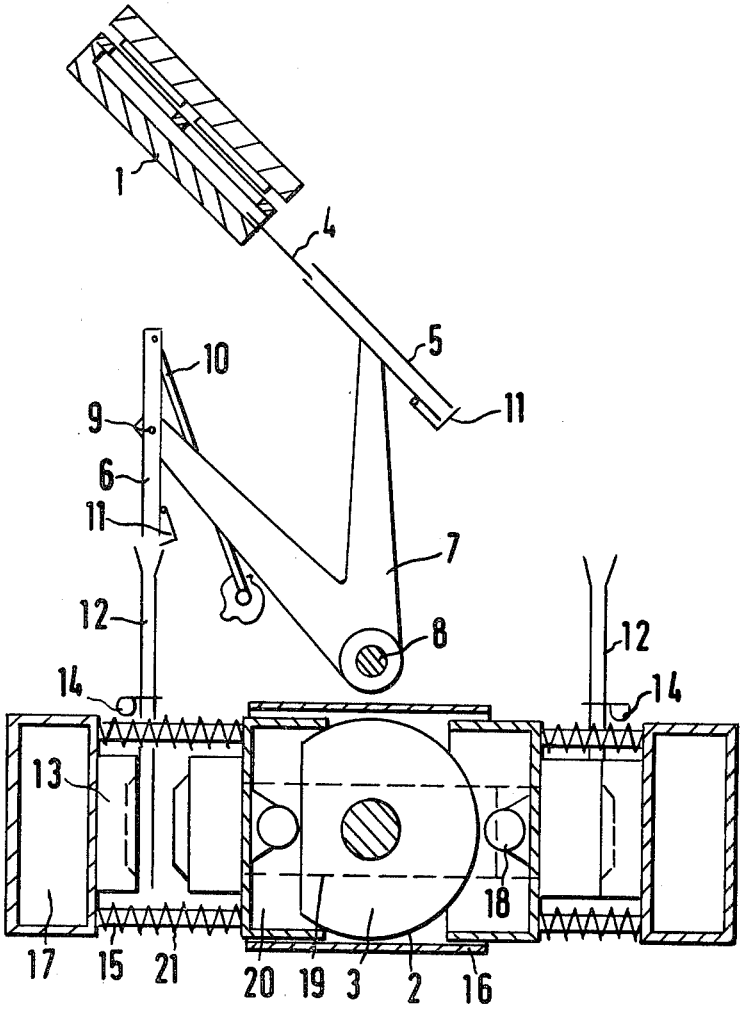
1
4
5
10
11
9
6
11
7
12
8
12
14
14
13
18
17
15
21
20
19
3
2
16

PROCESS AND APPARATUS FOR THE PRODUCTION OF CARDBOARD PLATES AND THE LIKE

FIELD OF THE INVENTION

The present invention relates to a machine and a process for producing cup- or plate-like pieces of material (for example cardboard plates) from ribbon or sheet material, using a punching apparatus, a multiple press coupled therewith as well as a device for distributing punched pieces between the punching apparatus and tools on the multiple press.

Machines are known in which pieces are punched from sheet-like materials and are then fed to a single drawing press by means of a chain transport system or by gravity.

Since, with most materials, it is essential for achieving a qualitatively satisfying deformation to retain each piece of material in the closed mould for a certain time, the production speed of the whole machine is determined by the number of strokes of the drawing press.

The disadvantage of the above systems accordingly consists in that other elements, which are capable for far higher output, are not fully employed.

SUMMARY OF THE INVENTION

It is the purpose of the present invention to find means and ways to avoid the above disadvantages.

This is achieved, according to the present invention, by feeding the pieces punched by a punching machine or the cut-off lengths of material to several presses in turn by means of a distributing device.

DESCRIPTION OF THE DRAWINGS

In order that the invention may be clearly understood and readily carried into effect one machine in accordance therewith will now be described, by way of example, with reference to the accompanying drawing which is a diagrammatic sectional elevation of the machine.

The FIGURE shows a punching apparatus 1 and a twin press 2 which are driven synchronously by a common drive. By means of gearing, the revolution speed of curved thrust elements 3 for closing the dies 13 in the twin press corresponds to half the number of strokes of a reciprocating punch on the punching apparatus. Thereby, a temporal and quantitative correspondence between the punching apparatus and the presses in the twin press is achieved. Pieces 4 punched by the punching apparatus 1 are transported by gravity alternately into transport containers 5, 6 which are fixed between two coaxial levers 7 each having two arms each of which can swing about an axis 8 from a filling position to an emptying position and then back to the filling position.

While the container 5 is rigidly connected to the levers 7, the container 6 is pivoted about its central axis 9. A link 10 connects one end of the container 6 with a lateral wall of the machine so that, with each swinging movement of the levers 7 from one extreme position into the other, the container 6 is rotated around its central axis 9. Therefore, in one extreme position, the container 6 can receive a piece 4 from the punching apparatus 1 and in the other extreme position it is located for the delivery of the piece to one of the presses, while the container 5 is in position for receiving a piece 4 from the apparatus 1. When the container 5 is in position to deliver this piece to the associated press, the container 6 is in position to receive another piece from the punching apparatus.

Closure flaps 11 respectively pivoted at opening ends of the containers 5, 6 and actuatable by pins provided on a lateral wall of the machine prevent the punched pieces from falling out prematurely from the containers 5, 6. It will be noted that the end of the container 6 remote from its closure flap 11 is permanently closed, while the end of the container 5 remote from its closure flap 11 is permanently open to receive a piece on reaching the punching apparatus. Thus the container 6 receives and delivers each piece at the same end but the container 5 receives and delivers each piece at opposite ends.

The punched pieces 4 fed by the above described distributing device into register with the input planes of the two drawing presses leave the containers 5, 6 under gravity and are guided by guiding elements 12 to press dies 13.

The exact moment of delivery of the punched pieces 4 to the dies 13 is determined by swivelling devices 14 actuated by the press mechanism.

The twin press 2 comprises two stationary press members 17, each of which is connected to a common press frame 16 by means of four rods 15, as well as two reciprocating rams 20 which are actuated by the two rotary thrust elements 3 by way of rollers 18 and which move on guide elements 19 connected to the press frame 16. Compression springs 21, respectively surrounding the rods 15, withdraw the rams 20 from the work.

The use of curved thrust elements 3 enables the closure and opening times of the presses to be adapted to a wide variety of work.

The punching apparatus may be arranged to punch the pieces 4 or simply to cut them off in series from a length of material.

I claim:

1. A machine for punching sheet material to produce separate punched pieces and distributing the punched pieces to presses in a multiple press, the machine comprising a punching apparatus for producing, in series, substantially flat pieces to be pressed, a multiple press comprising a plurality of presses each including a pair of dies for pressing one said piece when that piece is delivered between said dies, guiding elements allocated respectively to individual ones of said presses for guiding said pieces to said dies, and a distributing means for receiving, in series, all said pieces produced by said punching apparatus and for delivering them one by one in a cyclic sequence to said guiding elements such that during each cycle each guiding element receives one of said pieces.

2. A machine for punching sheet material to produce separate punched pieces and distributing the punched pieces to the two presses in a twin press, the machine comprising punching apparatus for producing, in series, pieces to be pressed, a twin press comprising two presses each having a pair of dies for pressing one said piece when that piece is delivered between said dies and means for alternately closing said pairs of dies, two guiding elements allocated respectively to individual ones of said presses for guiding said pieces to said pairs of dies, said twin press being spaced from said punching apparatus, an oscillating unit located between said punching apparatus and said twin press, said unit being mounted for oscillation about a fixed axis in timed relationship with the die closing action of said die closing means, and two transport containers mounted on said oscillating unit and positioned and arranged such that one container travels from said punching apparatus to one said guiding element while the other said container travels from the other said guiding element to said punching apparatus, and vice versa, during each oscillation cycle of said unit, each said container being adapted to receive on reaching said punching apparatus a piece to be pressed and to deliver that piece to the associated one of said guiding elements.

3. A machine according to claim 2, in which said two pairs of dies comprise two stationary dies, one in each pair, and two reciprocating dies mounted to travel along a horizontal path so as alternately to close on the associated stationary dies, said die closing means being interposed between said pairs of dies, said guiding elements extending substantially vertically upwards respectively from the vicinities of said pairs of dies, said oscillating unit being mounted between said guiding elements, said punching apparatus being mounted above said oscillating unit, and said transport containers being shaped to receive said pieces under gravity from said punching apparatus.

4. A machine according to claim 3, in which one of said transport containers is formed with openings respectively at opposite ends thereof for receiving a piece at one end and delivering the piece at the opposite end, and the second of said transport containers is permanently closed at one end and formed with an opening at the opposite end, the machine also comprising closure flaps, respectively pivoted at said opposite end of said one container and at said open end of said second container for maintaining said openings at each of said last-mentioned ends closed until reaching the associated guide element, each said closure flap being mounted for automatic opening by impact on closely approaching the associated one of said guide elements, said second container being pivotally mounted on said oscillating unit, and the machine further including means operable by said oscillating unit for presenting said open end of said second container alternately to said punching apparatus and the one of said guiding elements associated with said second container.

5. A machine according to claim 3, in which one of said transport containers is formed with openings respectively at opposite ends thereof for receiving a piece at one end and delivering the piece at the opposite end, and the second of said transport containers is permanently closed at one end and formed with an opening at the opposite end, said second container being pivotally mounted on said oscillating unit about an axis which is parallel to said fixed axis and which is located substantially midway between said open and said closed ends of said second container, and the machine also including a rigid link pivoted to said second container substantially at the closed end thereof and also pivoted about a point remaining in a fixed position during the operation of the machine, whereby, when said oscillating unit oscillates, said links rotates said second container on said oscillator between a position thereon for presenting said open end of said second container to said punching apparatus and a position for presenting said last mentioned open end to the associated one of said guiding element.

6. A machine according to claim 3, in which said die closing means comprises a rotary thrust member formed with a curved surface for exerting an actuating thrust alternately on said reciprocating dies for closing them each from an initial position towards the associated stationary dies, and spring means for returning each reciprocating die to its initial position.

7. A process for producing in series pressed pieces, comprising the steps of feeding flat blank material to a punching apparatus, operating said apparatus to produce in series flat pieces to be pressed, delivering said pieces in cyclic sequence to a plurality of guiding elements leading respectively to pairs of dies in a multiple press such that in each cycle each guiding element receives one piece, feeding individual ones of said pieces in sequence from said guiding elements to a position between the dies in each said pair thereof, and closing said pairs of dies sequentially in each cycle.

* * * * *